US008794503B2

(12) United States Patent
Burgos Agudo

(10) Patent No.: US 8,794,503 B2
(45) Date of Patent: Aug. 5, 2014

(54) DISPENSING LID INTENDED, IN PARTICULAR, FOR USE WITH FOOD-DISPENSING CONTAINERS

(75) Inventor: Luis Burgos Agudo, Barcelona (ES)

(73) Assignee: Oksana Kyfyuk, Valencia (ES)

( * ) Notice: Subject to any disclaimer, the term of this patent is extended or adjusted under 35 U.S.C. 154(b) by 257 days.

(21) Appl. No.: 13/143,821

(22) PCT Filed: Apr. 9, 2010

(86) PCT No.: PCT/ES2010/000150
§ 371 (c)(1),
(2), (4) Date: Jul. 8, 2011

(87) PCT Pub. No.: WO2010/122185
PCT Pub. Date: Oct. 28, 2010

(65) Prior Publication Data

US 2011/0266298 A1 Nov. 3, 2011

(30) Foreign Application Priority Data

Apr. 22, 2009 (ES) ..... 200901111

(51) Int. Cl.
*B65D 47/08* (2006.01)

(52) U.S. Cl.
USPC ..... 229/125.04; 222/364; 222/531

(58) Field of Classification Search
USPC ..... 229/125.04, 125.15, 215; 220/833; 222/364, 305, 535, 531, 533, 566, 572, 222/574
See application file for complete search history.

(56) References Cited

U.S. PATENT DOCUMENTS

| | | | | | |
|---|---|---|---|---|---|
| 1,619,315 | A * | 3/1927 | Ricketts | 222/364 |
| 3,187,961 | A * | 6/1965 | Moore | 222/346 |
| 3,250,436 | A * | 5/1966 | Kurtz | 222/153.07 |
| 3,982,683 | A * | 9/1976 | Forteau | 229/215 |
| 4,491,252 | A * | 1/1985 | Schmidt et al. | 222/531 |
| 5,012,959 | A * | 5/1991 | Gordon | 222/535 |
| 6,062,467 | A * | 5/2000 | Ours et al. | 229/117.3 |
| 6,145,736 | A * | 11/2000 | Ours et al. | 229/117.3 |
| 6,213,388 | B1 * | 4/2001 | Ours et al. | 229/117.3 |
| 2006/0000880 | A1 * | 1/2006 | Wein | 229/215 |
| 2008/0283557 | A1 * | 11/2008 | Desautels | 222/535 |

FOREIGN PATENT DOCUMENTS

| | | | |
|---|---|---|---|
| CH | 569629 | A5 | 11/1975 |
| FR | 2695625 | A1 | 3/1994 |
| GB | 2119773 | A * | 11/1983 |
| WO | 0123297 | A1 | 4/2001 |

* cited by examiner

*Primary Examiner* — Justin Larson
*Assistant Examiner* — Phillip Schmidt
(74) *Attorney, Agent, or Firm* — Richard M. Goldberg

(57) ABSTRACT

The invention comprises a frame (2) secured to a container and a movable body (3) articulated with one end of the frame (2) by means of a hinge (4) formed along a common edge of the bodies articulated therewith, said movable body (3) having two side walls (6) and a front wall (7). The invention is characterized in that both ends of the upper inner edge (2*c*) of the frame include a pair of flexible tongues (17) which, in the closed position, engage with respective recesses (10*a*) on the upper edge of the side walls (6) of the movable body (3) and on the end adjacent to the front wall (7). The movable body (3) and the fixed frame (2) include a cavity (12) next to the hinge (4), said cavity allowing the movement of material in the closed position. The invention provides an improved sealing and closure system.

19 Claims, 5 Drawing Sheets

DISPENSING LID INTENDED, IN PARTICULAR, FOR USE WITH FOOD-DISPENSING CONTAINERS

This application is a 371 of PCT/ES2010/000150 filed Apr. 9, 2010, which in turn claims the priority of ES P200901111 filed Apr. 22, 2009, the priority of both applications is hereby claimed and both applications are incorporated by reference herein.

OBJECT OF THE INVENTION

The present invention relates to a dispensing lid particularly applicable to containers for supplying food, such as grain products, cereals, nuts and dried fruit, etc.

BACKGROUND OF THE INVENTION

In the field of packaging consumer products such as cereals, rice, powder products form and the like, the use of cardboard packages internally having a hermetically sealed plastic or aluminium bag in which the product is located is known.

Nevertheless, the user of products of this type must open the package and bag manually so on certain occasions the bag tends to break more than is necessary. This gives rise to the possible spilling of the product which remains deposited in the existing space between the inner bag and the cardboard package.

To solve the aforementioned drawback, dispensing lids for containers or receptacles have been made for food products of this type, such as for example the lid described in patent Spanish invention patent number 2 154 537 the proprietor of which is the same as proprietor of the present application.

Patent number 2 154 537 describes a multifunctional container chassis for all types of containers with mechanical lids and anchoring bases, which mentions and describes a lid model for dispensing or pouring out the liquid or solid products secured to a container, as well as variants of the same lid. Said lids are all made up of a square or rectangular frame fixed to the container and a movable body like a dispensing lid with an opening outlet for the product, being attached to the frame and the movable body by means of a hinge.

DESCRIPTION OF THE INVENTION

The objective of the dispensing lid of the present invention is to provide technical improvements in dispensing lids of that type known in the art, further providing a plurality of advantages which will be described below.

The dispensing lid of the present invention is of the type comprising a first body fixed to the container made up of a frame defining an inner opening and a second movable body articulated to one end of the frame by means of a hinge formed by a common ridge of the bodies articulated thereto, which movable body is provided with two side walls and a front wall and is characterised by the fact that the frame has at both ends of its upper inner ridge a pair of flexible tabs which in the closed position are coupled in respective recesses located on the upper ridge of the side walls of the movable body and at the end adjacent to the front wall.

The movable body is therefore stabilised in the closed position, thus improving the closure of the dispensing lid.

The recesses of the upper ridge of each side wall in which the flaps are coupled advantageously have a height that decreases towards said front wall to thus ensure the position of the tabs.

Both the movable body and the fixed frame advantageously have next to the common ridge of the hinge a cavity which allows the movement of material taking place in the mentioned bodies when they are in the closed position, i.e., when they are placed next to each other.

As a result of these features, on one hand the articulation of the movable body with respect to the frame is improved, and on the other hand better tightness is obtained since the movable material of the area adjacent to the hinge is housed inside the mentioned cavity when the main body is closed on the frame, whereby the two facing walls of the frame and of the moving body are placed perfectly against one other without leaving any intermediate space therebetween. Furthermore, said improvement does not involve an increase in the cost of manufacturing the lid.

The movable body advantageously has at its inner end a sector or bridge attaching the side walls thereof, the front ridge of said bridge having a concave contour.

Due to said concave contour, the contents of the container are thus directed towards the central part, preventing them from spilling over the sides of the lid when being poured.

Similarly, according to another improvement of the invention, the upper ridge of the front wall of the movable body has a concave curvature which facilitates pouring the product in a directed and centred manner.

The front wall of the movable body and the frame advantageously comprise respective cut-outs at their lower ends.

As a result of these cut-outs, the closing of the lid is eased in the event of the product to be supplied spilling out over the sides since it prevents the spilled product from being placed in the gap formed by the lower ends of the front wall and of the frame.

The lid of the invention also advantageously comprises a pair of perimetric ribs on the inner face of the front wall.

Said ribs are coupled on the outer face of the frame, which is covered with a thin sheet against which the mentioned ribs press which behave as containment lips to assure tightness.

The invention also anticipates the side walls of the movable body having in the area close to the inner face of the front wall a sector of greater height which is in contact with the tabs in positions close to the closed position of the lid.

The tabs are thus readily coupled in the notches is facilitated and the movable body is maintained with certain stability in near the closed positions, preventing the easy opening of the lid during the handling of the container when it is not being used and providing slight resistance which facilitates the closure which follows when continuing to press the lid.

According to another feature of the invention, the lid has a locking wedge arranged in the bridge attaching the side walls of the movable body.

Preferably, the section of the wedge is a right triangular section, the inclined sector being the rear face of the wedge, such that during the lid assembly process, the introduction of the frame into the movable body is facilitated and at the same time the movement of said movable body is blocked when the lid is in use.

According to another feature, the side walls of the movable body have a toothed area at their inner end in contact with the tabs in maximum opening positions of the lid.

As a result of the contact between the teeth and the tabs the movable body is maintained in a plurality of opening positions. Furthermore, when the tabs pass through the toothed area they make a characteristic sound which can serve to identify the lid.

The frame is advantageously provided on its inner face with anchoring means for anchoring to the container. Better fixing of the lid to the container is thus secured.

The anchoring means for anchoring to the container preferably comprise lugs which can be riveted by thermal fusion.

According to another feature of the invention, the tabs have a recessed sector at their free end. Therefore when the thickness is reduced greater flexibility of the tab is provided when it contacts with the side walls of the movable body.

The bottom of the movable body preferably has a second attachment bridge between the side walls at a certain distance from the hinge. Therefore, since the bridge is at a certain distance from the hinge, the movement of the movable body through the frame is possible.

The front wall of the movable body advantageously has in the upper part of the outer face a gripping flange considerably perpendicular to the plane of said front wall. The opening of the lid by the user is facilitated as a result of the presence of said projection and its arrangement perpendicular to the plane of the front wall.

The lower inner edge of the frame also advantageously has a rounded profile for its fitting on the second attachment bridge in the lower part of the latter.

The frame advantageously has a flap on its front surface surrounding the front wall of the movable part and having a length equal to the thickness of said front wall such that in the closing position of the lid the flap is flush with the front wall of the movable part. This flap facilitates the placement of a seal as it allows said placement to be frontal, and increases the seal tightness provided by said seal.

In an embodiment of the invention, the sector or bridge attaching the side walls of the movable body has a downward extension providing greater control over the exit of the product, especially in the case of granulated products.

In an embodiment of the invention, the gripping flange defined on the outer face of the front wall of the movable body advantageously covers the entire width of said front wall, providing it with greater rigidity and preventing its lateral bending due to the stresses to which it is subjected during the lid opening operation.

BRIEF DESCRIPTION OF THE DRAWINGS

For the purpose of facilitating the description provided above, a set of drawings is attached in which a practical embodiment of the dispensing lid of the invention is depicted schematically and only as a non-limiting example, in which.

PREFERRED EMBODIMENT OF THE INVENTION

Figure 1:
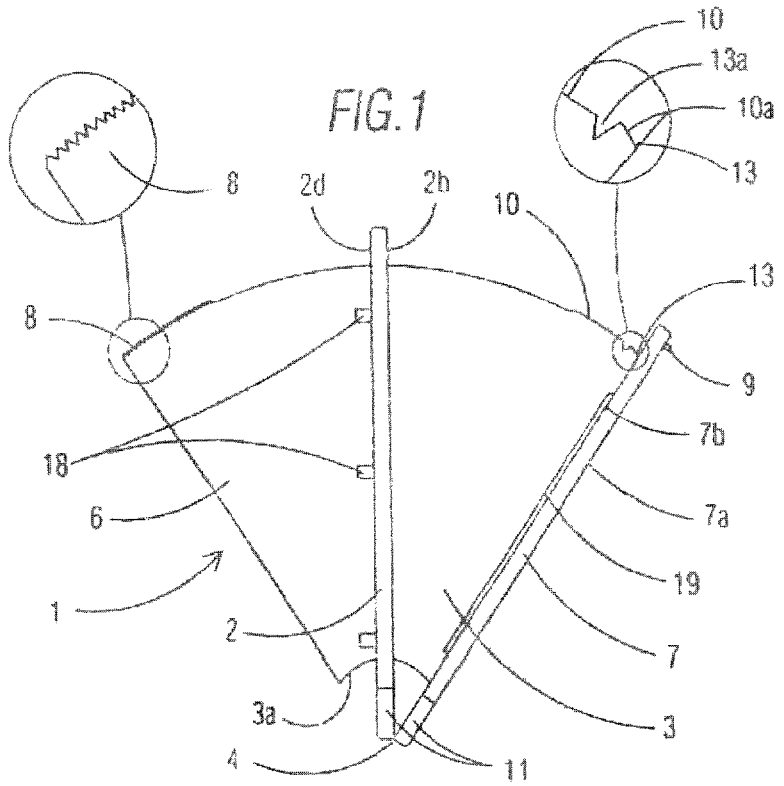
FIG. 1 is a side elevational view of the dispensing lid of the invention in a half-opened position, including a detailed view of the toothed area and another of the notched area.
Figure 2:
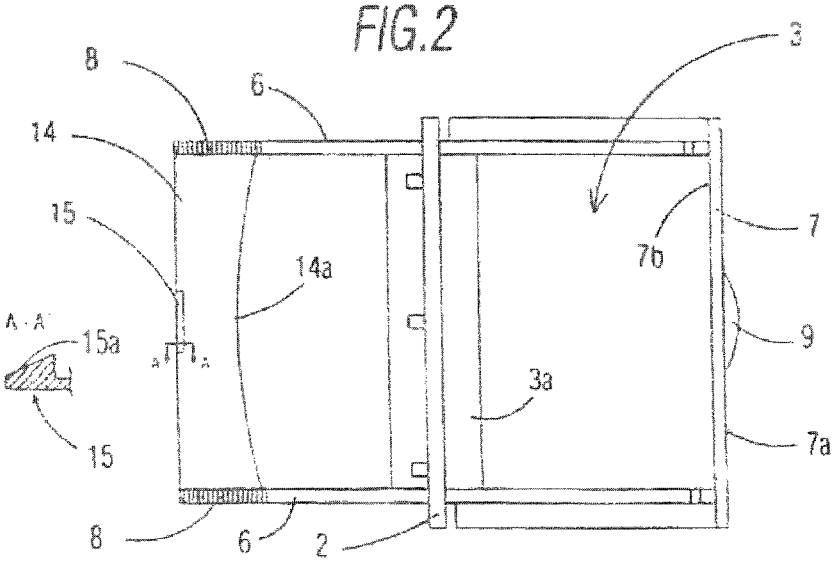
FIG. 2 is a plan view of the aforementioned dispensing lid, including a sectional detail view of the wedge.
Figure 8:
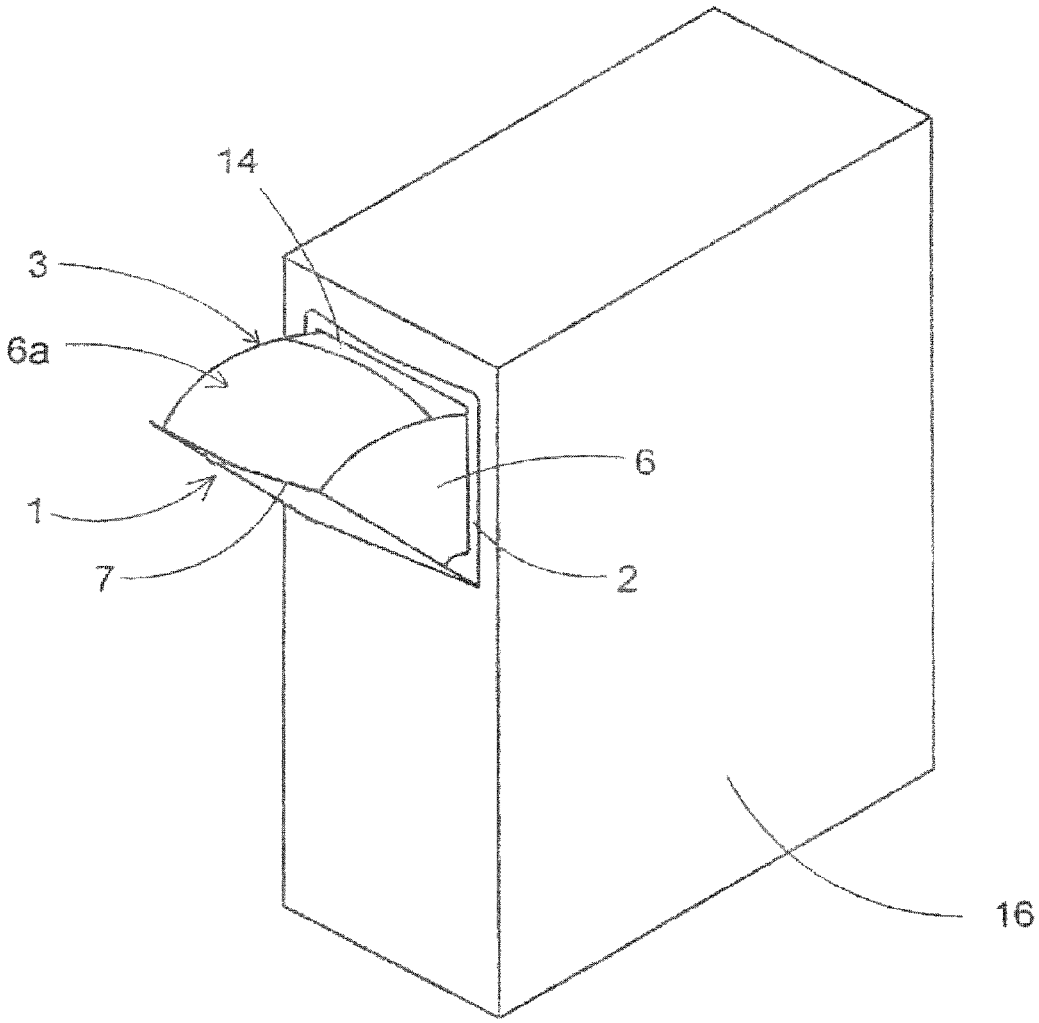
FIG. 8 is a schematic perspective view of an example of the lid of the invention applied on a cardboard container.

As can be seen in FIGS. 1 and 2, the dispensing lid 1 according to the invention particularly applicable to containers for supplying food such as legumes, nuts and dried fruit, cereals, etc., comprises a body fixed to the container formed by a rectangular frame 2 defining an inner opening 2*a* (in dotted lines in FIG. 3) and a second movable body 3. Said movable body is articulated to the frame 2 in the lower part by means of a hinge 4 formed by a common ridge 5 (FIG. 5) of the bodies 2, 3 articulated thereto. The movable body 3 is provided with two side walls 6 and a front wall 7 of little thickness defining an outlet 6*a* for product (FIG. 8). The movable body 3 has an attachment bridge 3*a* facilitating el movement of said body through the frame 2.

Particularly referring to FIG. 1, a toothed area 8 of little height can be seen at one end of the upper ridges of the side walls 6 of the movable body, which area acts as a positioning means for said movable body 3 with respect to the frame 2.

The front wall 7 of the movable body 3 has a gripping flange 9 in the central upper part of its outer face 7*a* which helps the user open the lid 1.

The side walls 6 of the movable body 3 are provided with a sector 10 of greater height in the area close to the front wall 7. Said sector 10 allows contact between the frame 2 and the movable body 3 in order to prevent the possible involuntary opening of the lid of the invention.

Figure 3:
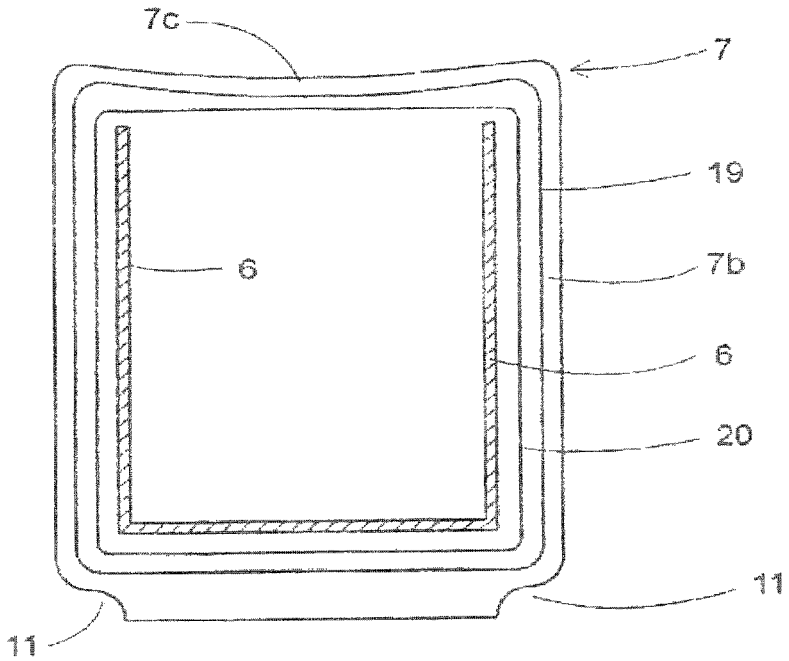
FIG. 3 is a front elevational view of the dispensing lid.

The outer face 2*b* of the frame 2, which is in contact with the inner face 7*b* of the front wall 7, is provided with a thin polyethylene sheet (not depicted) which allows assuring the tightness of the container FIGS. 1 and 3 show how the front wall 7 of the movable body 3 and the frame 2 comprise a cut-out 11 at both lower ends which allows pouring out the product that may have spilled over the sides when supplying the product.

FIG. 3 shows how the front wall 7 has a concave curvature in its upper ridge 7*c* which facilitates optimal exit of the product inside the receptacle. This curvature 7*c* seeks to prevent the product from spilling over the sides.

Figure 4:
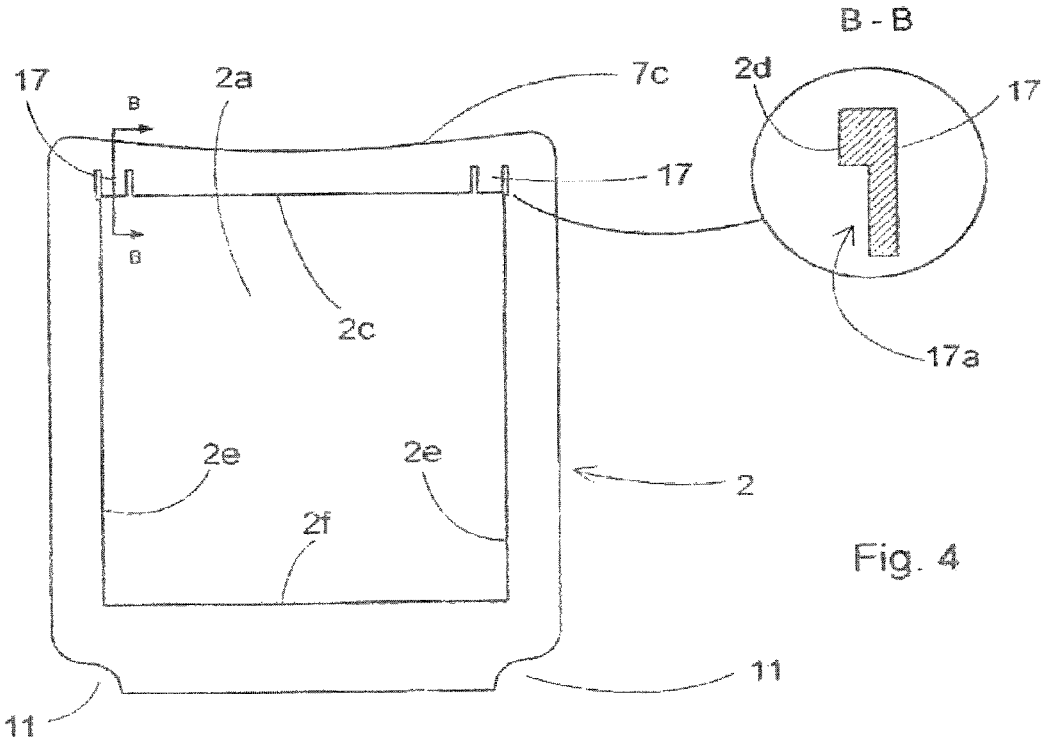
FIG. 4 is a front view of the frame including a sectional detail of the tab.

As shown in FIG. 4, the dispensing lid 1 of the invention has in the frame 2, and more precisely at both ends of its inner upper ridge 2*c*, a pair of flexible tabs 17 which are coupled in two recesses 13 located on the upper ridge of the side walls 6 of the movable body 3 and at the end adjacent to the inner face 7*b* of the front wall 7. The tabs 17 have a recess 17*a* at their free end which provides greater flexibility of the tab, the tabs 17 being housed in the closed position at the end of the ridge 10*a*. The recess 17*a* is located on the inner face 2*d* of the frame 2. On the other hand, as shown in FIG. 4, the outer ridges of the tabs 17 are aligned with the inner ridges 2*e* of the frame 2.

FIG. 1 shows how the sector comprised between the notch 13*a* and the front wall 7 has a ridge 10*a* of height that decreases towards said front wall 7, thus ensuring better closure of the dispensing lid The frame 2 of the dispensing lid is provided on the face linked to the container 16 (FIG. 8), with anchoring means for fixing the lid to the container 16, said means being a plurality of small lugs 18 or clamps which are inserted into previously made boreholes in the container (16). Said lugs are preferably riveted by thermal fusion.

On the other hand, the movable body 3 has at one end an attachment sector or bridge 14 (FIG. 2) attaching the side walls 6 of the mentioned body 3, the front ridge 14*a* having a contour with a concave curvature which facilitates pouring the product and prevents it from spilling over the sides of the outlet of the lid. Said bridge 14 includes a locking wedge 15 at the rear end which has a right triangular profile, the inclined sector 15*a* being the rear face of the wedge 15 (see detailed view), which facilitates assembling the frame 2 on the body 3.

Figure 5:
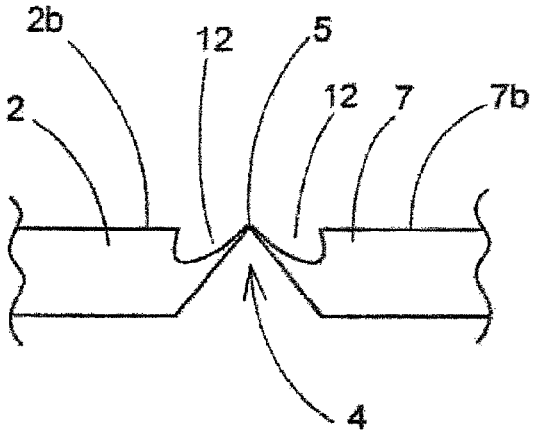
FIG. 5 is a side detail view of the hinge attaching the frame to the movable body of the lid in an open position.
Figure 6:
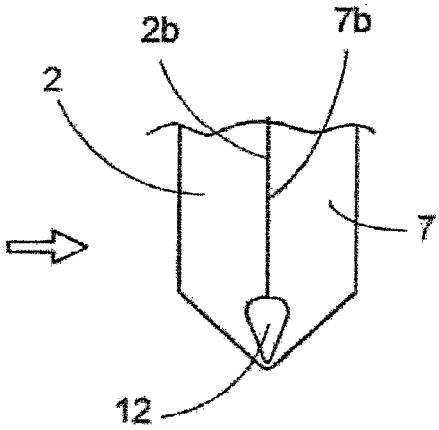
FIG. 6 is the same view as in FIG. 5, in a closed position.

Referring to FIGS. 5 and 6, the hinge 4 of the lid 1 has a small cavity 12 which allows the movement of material taking place in the frame 2 and in the front wall 7 of the movable body 3 when they are in the closed position, the two facing faces 2*b*, 7*b* of the frame 2 and the front wall of the movable body 3 being perfectly coupled to one another. Despite the movement of material of both bodies 2, 3 being minimal in the absence of the cavities according to the invention, such movement would be enough to deny perfect contact between the frame 2 and the front wall 7 and produce a small slit or opening between the two facing walls where the product could leak out, preferably a powder product, from inside the container.

Figure 7:
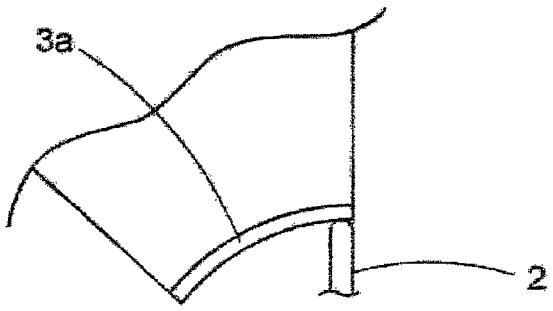
FIG. 7 is a detail of the lower inner edge of the frame and of the second attachment bridge.

As can be seen in FIG. 7, the lower inner edge 2*f* of the frame 2 has a rounded profile for its fitting on the second attachment bridge 3*a* which has a curved profile.

FIG. 8 more clearly shows an example of the arrangement of the dispensing lid 1 of the invention on a container 16, for example, a rectangular cardboard receptacle.

The lid 1 of the invention can have a seal which, in the embodiment shown in FIG. 4, is adhered on the outer part of the frame 2 of the lid.

Figure 9:
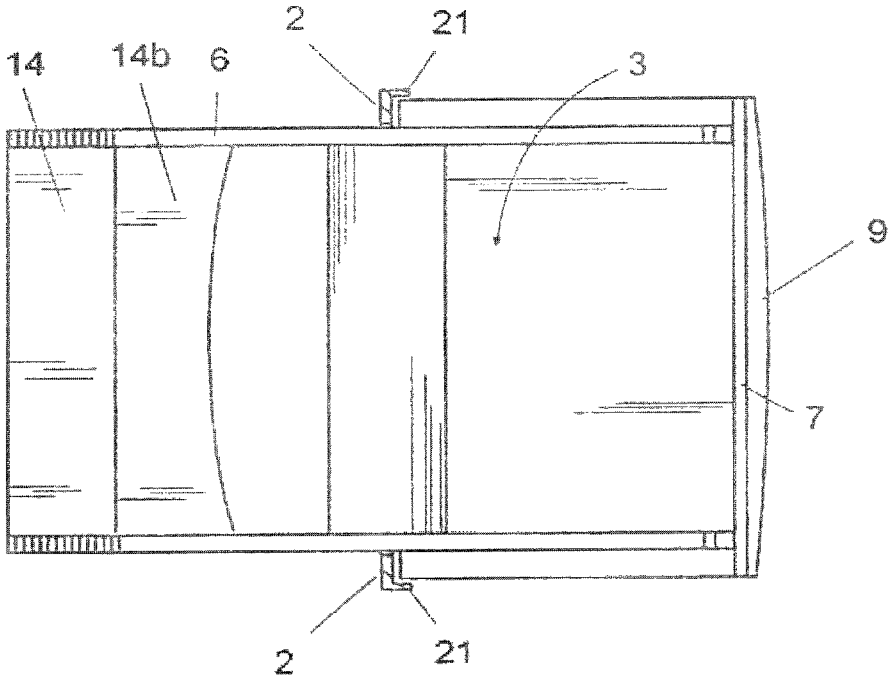
FIG. 9 is a top plan view of an embodiment variant of the dispensing lid, in which the frame has been sectioned by a horizontal plane.
Figure 10:
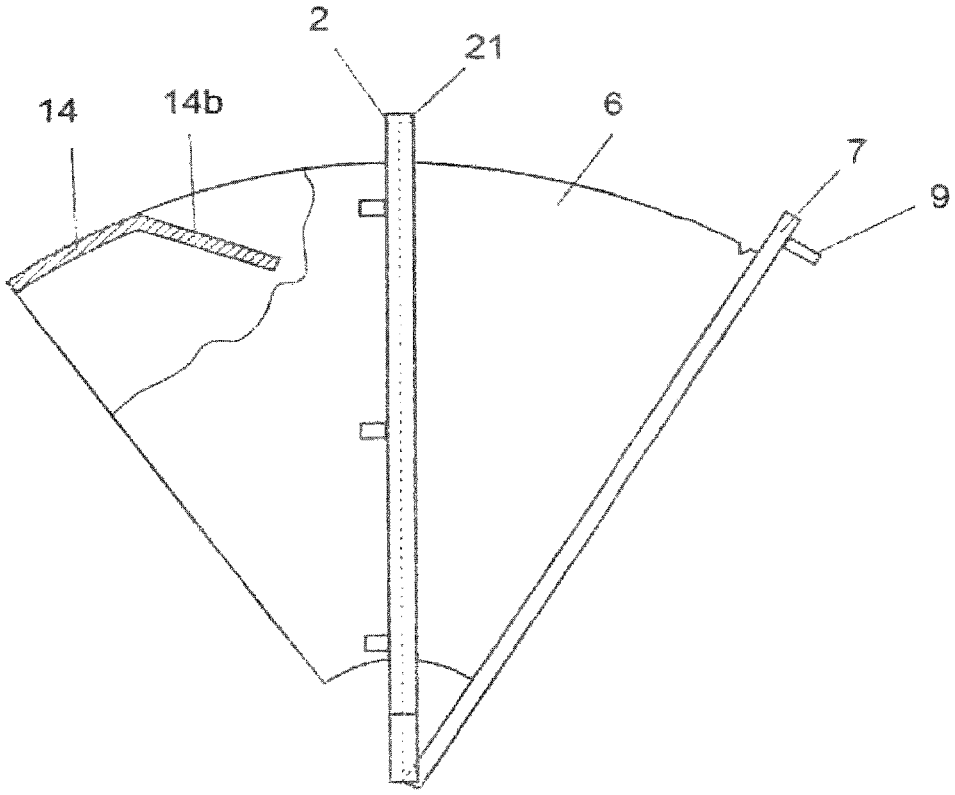
FIG. 10 is a side elevational view of the dispensing lid of the preceding figure which has been partially sectioned so as to allow observing the extension of the sector or bridge attaching the side walls of the movable body.

In the embodiment variant shown in FIGS. 9 and 10, the frame 2 has a flap 21 on its front surface surrounding the front wall 7 of the movable body 3 and having a length equal to the thickness of said front wall such that in the closed position of the lid 1, the flap 21 is flush with the outer surface 7*a* of the front wall 7. This flap 21 facilitates the placement of a seal 71 as it allows said placement to be frontal, and increases the seal tightness provided by said seal.

In said FIGS. 9 and 10, the sector or bridge 14 attaching the side walls of the movable body 3 has a downward extension 14*b* providing greater control over the exit of the product, especially in the case of granulated products.

In the embodiment variant shown in the aforementioned FIGS. 9 and 10, the gripping flange 9 defined on the outer face 7*a* of the front wall 7 of the movable body 3 covers the entire width of said front wall 7, providing it with greater rigidity and preventing the lateral bending of the front wall 7 due to the stresses to which it is subjected during the lid opening operation.

The materials used to manufacture the different elements making up the dispensing lid which has been described will be independent from the object of the present invention, as will the shapes and dimensions thereof and all the accessory details that they may have, being able to be replaced by others which are technically equivalent, as long as they do not affect their essential nature or depart from the scope defined by the following claims.

The invention claimed is:

1. A dispensing lid particularly applicable to containers for supplying food, comprising:

a first body fixed to the container, the first body including a frame defining an inner opening, and a second movable body articulated at one end of the frame by a hinge formed by a common ridge of the first and second bodies, the movable body including:

two side walls, each having an upper ridge, a front wall, and recesses located on the upper ridges of the side walls adjacent said front wall, and the frame including an upper inner ridge and a pair of flexible tabs at opposite sides of the upper inner ridge, with the pair of flexible tabs being coupled, in a closed position, in respective ones of said recesses located on the upper ridges of the side walls of the movable body, and the front wall extending outwardly of the side walls to form an outer peripheral portion, and the frame including flaps extending perpendicular from the side walls of the frame to receive the outer peripheral portion of the front wall therein, in a closed position of the lid, with a front surface of the frame being coplanar with and receiving the outer peripheral portion of the front wall in a sealing manner.

2. The dispensing lid according to claim 1, wherein the recesses on the upper ridges of each side wall are each spaced slightly away from the front wall, and a portion of an upper edge of each side wall between the respective recess and the front wall decreases in height toward the front wall.

3. The dispensing lid according to claim 1, wherein each of the movable body and the fixed frame has, next to the common ridge of the hinge, a recess which allows movement of material taking place in the first and second bodies when the first and second bodies are in a closed position.

4. The dispensing lid according to claim 1, wherein the movable body includes a bridge at an inner end thereof, connected between said side walls thereof, the bridge having a front ridge with a concave contour.

5. The dispensing lid according to claim 1, wherein the front wall of the movable body includes an upper edge, and the entire upper edge of the front wall has a concave curvature.

6. The dispensing lid according to claim 1, wherein the front wall of the movable body and the frame comprise respective cutouts at lower ends thereof, said cutouts being separate and apart from the hinge.

7. The dispensing lid according to claim 1, wherein the frame includes a planar surface, and further comprising a pair of perimetric ribs on an inner face of the front wall at positions outside of the side walls of the movable body and which engage against the planar surface of the frame.

8. The dispensing lid according to claim 1, wherein the side walls of the movable body each include, in an area close to an inner face of the front wail, a sector of raised height which is in contact with the tabs in positions close to the closed position of the lid, the sector having an upper edge of a constant height throughout the sector.

9. The dispensing lid according to claim 1, wherein an upper edge of each of the side walls of the movable body has a toothed area at a rear end thereof which is in contact with the tabs in a range of positions of the lid between a near opened position and a completely opened position.

10. The dispensing lid according to claim 1, wherein the frame is provided on an inner face thereof with an anchoring arrangement for anchoring to the container.

11. The dispensing lid according to claim 10, wherein the anchoring arrangement includes lugs which are adapted to be riveted to the container by thermal fusion.

12. The dispensing lid according to claim 1, the movable body includes an attachment bridge at a bottom thereof and extending between the side walls at a predetermined distance from the hinge.

13. The dispensing lid according to claim 1, wherein the front wall of the movable body includes, in a part of an outer face thereof, a gripping flange which is adapted to extend perpendicular to a plane of said front wall.

14. The dispensing lid according to claim 13, wherein the gripping flange covers the entire width of said front wall.

15. The dispensing lid according to claim 1, wherein the movable body includes a bridge at an inner end thereof, connected between said side walls, the bridge having a downward extension for controlling exit of product being supplied through the lid.

16. A dispensing lid particularly applicable to containers for supplying food, comprising:

a first body fixed to the container, the first body including a frame defining an inner opening, and a second movable body articulated at one end of the frame by a hinge formed by a common ridge of the first and second bodies, the movable body including:

two side walls, each having an upper ridge, a front wall, and recesses located on the upper ridges of the side walls adjacent said front wall, the frame including an upper inner ridge and a pair of flexible tabs at opposite sides of the upper inner ridge, with the pair of flexible tabs being coupled, in a closed position, in respective ones of said recesses located on the upper ridges of the side walls of the movable body, and the movable body includes a bridge at an inner end thereof, connected between said side walls, and the bridge includes a locking wedge.

17. The dispensing lid according to claim 16, wherein the locking wedge has a right triangular section having an inclined sector which is a rear face of the wedge.

18. A dispensing lid particularly applicable to containers for supplying food, comprising:

a first body fixed to the container, the first body including a frame defining an inner opening, and a second movable body articulated at one end of the frame by a hinge formed by a common ridge of the first and second bodies, the movable body including:

two side walls, each having an upper ridge, a front wall, and recesses located on the upper ridges of the side walls adjacent said front wall, and the frame including an upper inner ridge and a pair of flexible tabs at opposite sides of the upper inner ridge, with the pair of flexible tabs being coupled, in a closed position, in respective ones of said recesses located on the upper ridges of the side walls of the movable body, the movable body includes an attachment bridge at a bottom thereof and extending between the side walls at a predetermined distance from the hinge, and the frame has a lower inner edge with a rounded profile for receiving the attachment bridge thereon.

19. A dispensing lid particularly applicable to containers for supplying food, comprising:

a first body fixed to the container, the first body including a frame defining an inner opening, and a second movable body articulated at one end of the frame by a hinge formed by a common ridge of the first and second bodies, the movable body including:

two side walls, each having an upper ridge, a front wall, and recesses located on the upper ridges of the side walls adjacent said front wall, and the frame including an upper inner ridge and a pair of flexible tabs at opposite sides of the upper inner ridge, with the pair of flexible tabs being coupled, in a closed position, in respective ones of said recesses located on the upper ridges of the side walls of the movable body, and each tab has a recessed sector at a free end thereof.

* * * * *